US010468844B2

(12) United States Patent
Xu et al.

(10) Patent No.: US 10,468,844 B2
(45) Date of Patent: Nov. 5, 2019

(54) PLUG-TYPE LAMP

(71) Applicant: OPPLE LIGHTING CO., LTD., Shanghai (CN)

(72) Inventors: Qi Xu, Shanghai (CN); Ming Chen, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 15/961,879

(22) Filed: Apr. 25, 2018

(65) Prior Publication Data

US 2018/0309252 A1 Oct. 25, 2018

(30) Foreign Application Priority Data

Apr. 25, 2017 (CN) ..... 2017 2 0441363 U

(51) Int. Cl.

| | |
|---|---|
| ***H01R 33/06*** | (2006.01) |
| ***F21V 23/06*** | (2006.01) |
| ***H01R 43/20*** | (2006.01) |
| ***F21V 17/16*** | (2006.01) |
| ***H01R 13/11*** | (2006.01) |
| ***F21V 19/00*** | (2006.01) |
| ***F21S 8/00*** | (2006.01) |

(52) U.S. Cl.

CPC ..... *H01R 33/06* (2013.01); *F21S 8/035* (2013.01); *F21V 17/16* (2013.01); *F21V 19/00* (2013.01); *F21V 19/0045* (2013.01); *F21V 23/06* (2013.01); *H01R 13/11* (2013.01); *H01R 13/113* (2013.01); *H01R 43/20* (2013.01)

(58) Field of Classification Search

CPC ..... H01R 33/06; H01R 43/20; H01R 13/11; H01R 13/113; F21S 8/035; F21V 19/0045; F21V 23/06; F21V 19/00; F21V 17/16; F21V 19/0005

See application file for complete search history.

(56) References Cited

U.S. PATENT DOCUMENTS

| | | | | |
|---|---|---|---|---|
| 9,605,845 | B2 * | 3/2017 | Chien | F21V 33/0076 |
| 10,228,112 | B2 * | 3/2019 | Chien | F21V 14/00 |
| 2007/0259574 | A1 * | 11/2007 | Kirstein | H01R 4/4818 439/839 |
| 2015/0138764 | A1 * | 5/2015 | Dai | F21V 23/06 362/231 |
| 2015/0167957 | A1 * | 6/2015 | Chien | F21V 33/0076 362/20 |
| 2015/0211701 | A1 * | 7/2015 | Chien | F21S 8/035 362/644 |
| 2015/0354792 | A1 * | 12/2015 | Chien | F21V 17/002 362/158 |
| 2016/0211682 | A1 * | 7/2016 | Chien | F21S 8/035 |
| 2016/0313636 | A1 * | 10/2016 | Chien | G03B 29/00 |
| 2018/0038556 | A1 * | 2/2018 | Zhao | F21K 9/272 |
| 2018/0105744 | A1 * | 4/2018 | Wang | C09K 11/675 |

* cited by examiner

*Primary Examiner* — Joseph L Williams
*Assistant Examiner* — Jose M Diaz
(74) *Attorney, Agent, or Firm* — Arch & Lake LLP

(57) ABSTRACT

A plug-type lamp is disclosed. The lug-type lamp includes a base with a plug part, where the plug part is configured to be plugged in a socket and be electrically connected with the socket; a light source module housed in the base; a pair of conductive terminals configured to electrically connect the plug part with the light source module; and a cover assembled with the base.

17 Claims, 7 Drawing Sheets

PLUG-TYPE LAMP

CROSS-REFERENCE TO RELATED APPLICATIONS

This application is based upon and claims the priority of Chinese Patent Application No. 201720441363.8 filed on Apr. 25, 2017, the entire content of which is hereby incorporated by reference herein for all purposes.

TECHNICAL FIELD

The examples of the disclosure relate to the field of lighting technology, and in particular to a plug-type lamp.

BACKGROUND

At present, a lamp or electrical appliance using a plug generally fixes L-pole and N-pole contacts of a plug pin with a cable by welding to achieve electrical connection between the plug pin and the electrical appliance. Under normal circumstances, a material of the plug pin is copper. Because a thermal conductivity of copper is very good, a heat generated during welding the cable can be transferred to a plastic part fixing the plug pin, and the plastic part can be easily deformed by the heat. In addition, welding the cable not only consumes labors and affects productivity but also pollutes the environment due to gas generated during welding, and the gas requires to be pumped away. In a night light/lamp, a cable for L-pole and N-pole of a light source board need to be manually inserted, thereby increasing the cost of producing the product.

SUMMARY

The present disclosure provides a plug-type lamp and a method of producing a plug-type lamp.

According to a first aspect of the present disclosure, a plug-type lamp is provided. The plug-type lamp may include: a base with a plug part, wherein the plug part may be configured to be plugged in a socket and be electrically connected with the socket; a light source module housed in the base; a pair of conductive terminals configured to electrically connect the plug part with the light source module; and a cover assembled with the base.

According to a second aspect of the present disclosure, a method of producing a plug-type lamp is provided. The method may include providing a base with a plug part where the plug part is configured to be plugged in a socket and be electrically connected with the socket; providing a light source module housed in the base; providing a pair of conductive terminals configured to electrically connect the plug part with the light source module; and providing a cover assembled with the base.

It is to be understood that both the forgoing general description and the following detailed description are exemplary and illustrative only, and do not limit the present disclosure.

BRIEF DESCRIPTION OF THE DRAWINGS

Various other advantages and benefits will become well understood to those of ordinary skill in the art by reading the following detailed description of the examples. The drawings are only for purposes of illustrating examples and are not to be construed as limiting the disclosure. Also throughout the drawings, the same reference numerals refer to the same parts. In the drawing.

DETAILED DESCRIPTION

Figure 1:
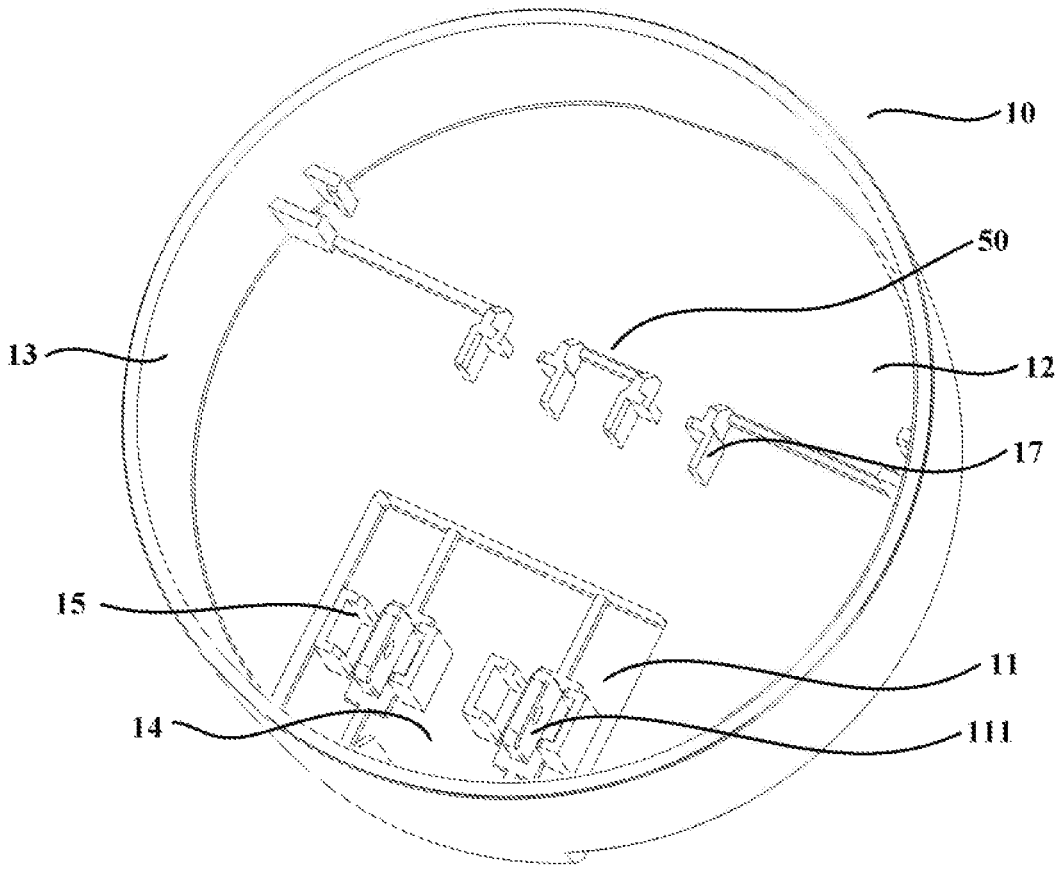
FIG. 1 is a schematic diagram of a base of a plug-type lamp according to an example of the present disclosure.
Figure 2:
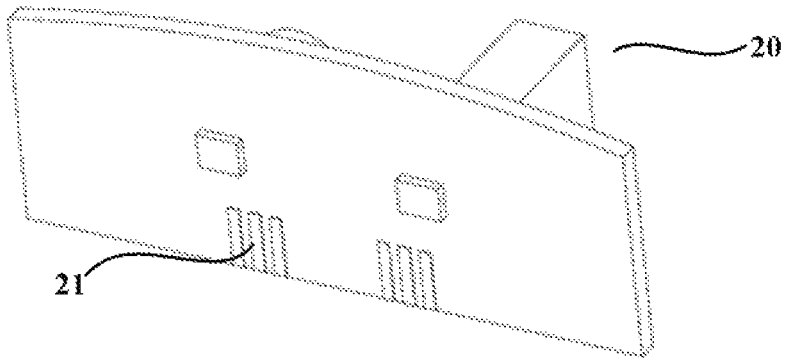
FIG. 2 is a schematic diagram of a light source module according to an example of the present disclosure.

Examples of the present disclosure will be described below in more details with reference to the accompanying drawings. Although the drawings show examples of the present disclosure, it should be understood that the present disclosure may be implemented in various forms and should not be limited by the examples set forth herein. In addition, these examples are provided so that this disclosure will be better understood, and that the scope of the disclosure will be fully conveyed to those skilled in the art.

The present example provides a plug-type lamp. As illustrated in FIGS. 1, 2, 3, and 4, the plug-type lamp includes: a base 10 with a plug part 11, the plug 11 is configured to be plugged in and electrically connected with a receptacle; a light source module 20 housed in the base 10; a pair of conductive terminals 30 for electrically connecting the plug part 11 with the light source module 20; and a cover 40 assembled with the base 10.

The base 10 has a bottom wall 12 and a side wall 13 extending perpendicularly from an outer periphery of the bottom wall. In this example, the bottom wall 12 is preferably circular. The bottom wall 12 can also be configured to have a rectangular shape, a square shape or other shapes, which is not limited in the present disclosure.

The plug part includes two plug pins 111. The bottom wall 12 of the base 10 is provided with a through hole 14 for receiving and fixing each of the plug pins 111. A first rib 15 perpendicular to the bottom wall 10 is disposed on both side of the through hole 14, and the first rib 15 is configured to position an end of each of the conductive terminals which is in contact with the plug pin 111. In this example, the first rib 15 is disposed on both sides of the plug pin 111, which not only facilitates inserting the conductive terminal 30 into the plug pin 111, but also avoids poor contact due to a material yielding deformation. Obviously, the manner of positioning the conductive terminal 30 provided in this example is only one of multiple modes. In specific applications, there can be other implementations.

In this example, the light source module 20 is provided with two power supply contacts 21, and the other ends of the conductive terminals 30 are respectively in contact with the two power supply contacts 21. The two power supply contacts 21 on the light source module 20 can be L-pole and N-pole contacts. After a power supply is energized, an electrical current passes through the conductive terminals 30 to arrive at the two contacts on the light source module 20 to provide power for a light source on the light source module 20.

In the solution provided by this example, an end of each of the two conductive terminals 30 is in contact with one of the two plug pins 111, and the other end of each of the two conductive terminals 30 is in contact with one of the two power supply contacts 21, so that a stable electrical connection is achieved without artificially welding cables. At the same time, the issue that the plastic part of the plug pin 111 is deformed due to heat generated in welding is solved, thereby improving the current poor efficiency of manual welding and the unstable manufacturing process, so as to effectively improve the production efficiency.

Figure 5:
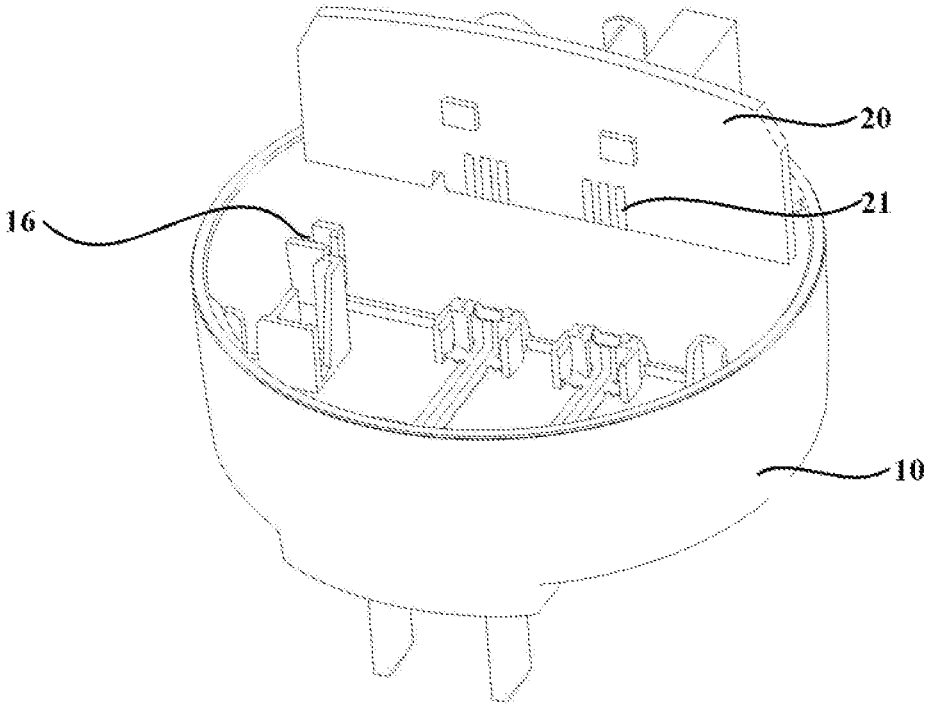
FIG. 5 is a schematic diagram of mounting a light source module on a base according to an example of the present disclosure.

In an example of the present disclosure, a clamping part 50 for receiving the light source module 20 is formed on the side wall 13 by two ends of the clamping part 50 extending from opposite locations on the side wall 13; a first receiving slot 16 perpendicular to the bottom wall 13 is disposed at a position where each of the two ends of the clamping part is connected with the side wall 13, and the first receiving slot 16 is configured to receive and fix the light source module 20; the light source module 20 can be inserted in the first receiving slot 16 so as to be fixed on the base 10, as illustrated in FIG. 5.

Further, a middle of the clamping part 50 can be provided with a second rib 17 perpendicular to the bottom wall 12. As illustrated in FIG. 1, the second rib 17 can be configured to fix the other end of each of the conductive terminals 30.

In an example of the present disclosure, one or more of the following structures can be further provided in order to further ensure the stable installation of the conductive terminal 30.

Figure 3:
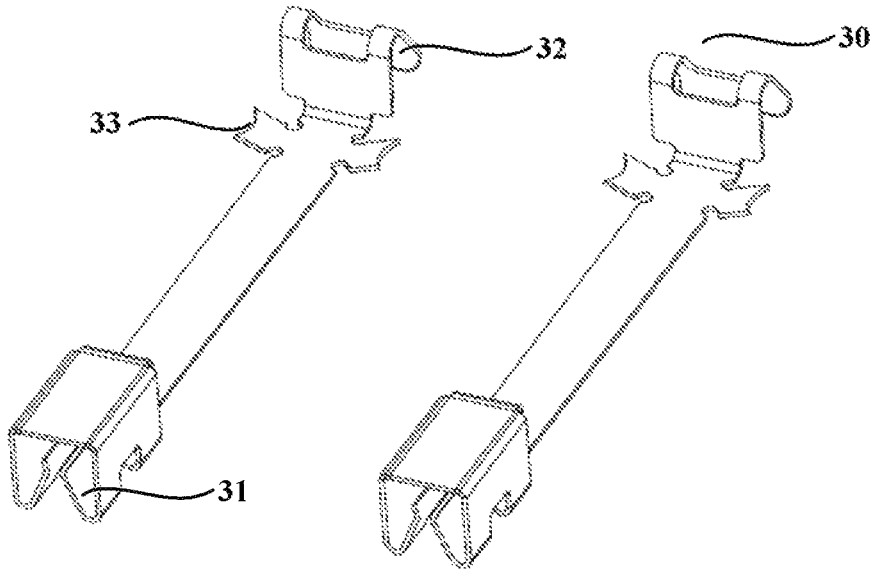
FIG. 3 is a schematic diagram of a conductive terminal according to an example of the present disclosure.
Figure 4:
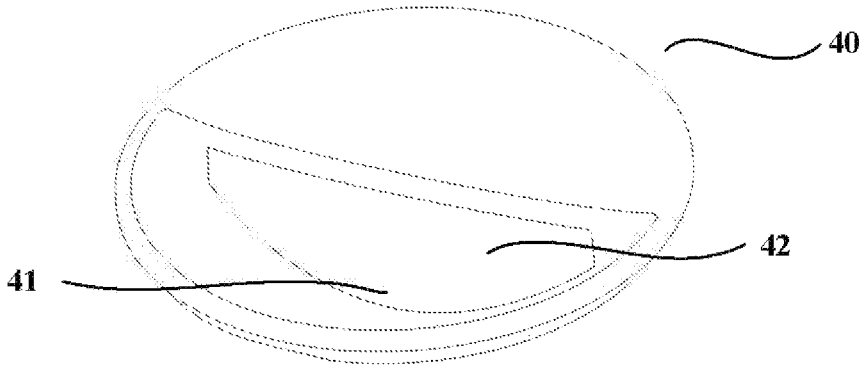
FIG. 4 is a schematic diagram of a cover according to an example of the present disclosure.

Preferably, an end of the conductive terminal 30 that is in contact with the plug pin 111 has both sides extending downward to form a double-V-shaped bend 31. As illustrated in FIG. 3, the double-V-shaped bend 31 holds the plug pin 111, thereby keeping the conductive terminal 30 being in close contact with the plug pin 111. An end of the conductive terminal 30 that is in contact with the power supply contact 21 has a central portion extending upward to form an inverted-V-shaped bend 32. A resilience force is formed after the inverted-V-shaped bend 32 is in contact with the power supply contact 21, so as to keep the conductive terminal 30 being in contact with the power supply point 21.

Figure 6:
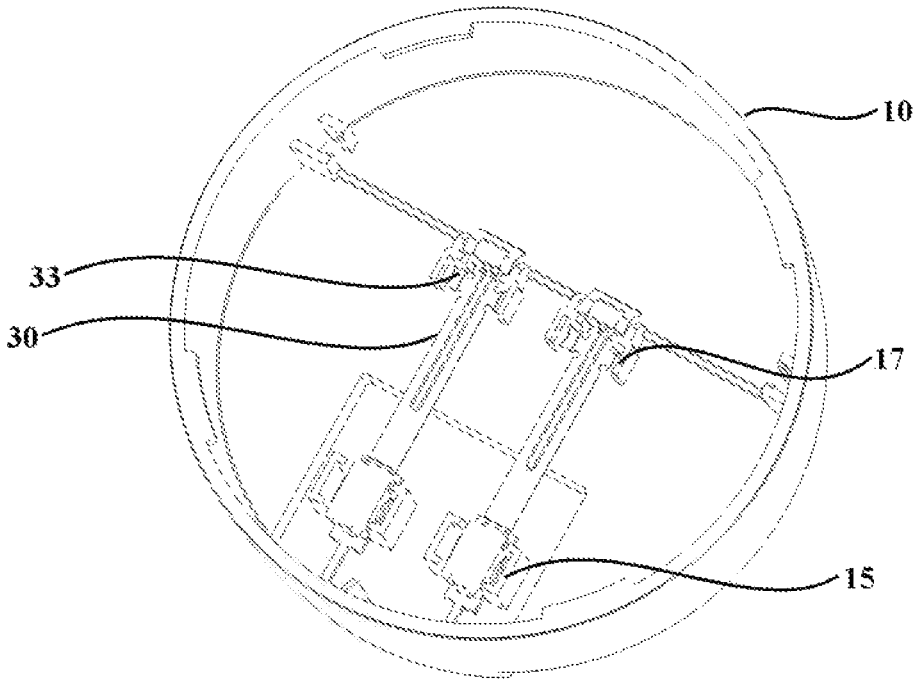
FIG. 6 is a schematic diagram of mounting a conductive terminal on a base according to an example of the present disclosure.

Further, in order to prevent the conductive terminal 30 from retracting when subjected to an external force, an upward-protruding sharp portion 33 is provided on both sides of an end of the conductive terminal 30 close to the power supply contact 21. Embedding the sharp portion 33 into the second rib 17 can make the contact between the conductive terminal 30 and the base 10 more secure. FIG. 6 is a schematic diagram of mounting the conductive terminal 30 on the base 10.

Preferably, the power supply contact 21 can be formed into a plurality of vertically arranged, strip-shaped, metal sheets. When the light source module 20 is inserted into the first receiving slot 16 of the base 10, the conductive terminal 30 will be in contact with the strip-shaped metal sheets of the power supply contact 21 on the light source module 20, so that an electrical transmission can be performed. Of course, the metal sheets can also be designed into other shapes, which will not be enumerated herein. Preferably, a material of the metal sheet is tin on bare copper.

Figure 7:
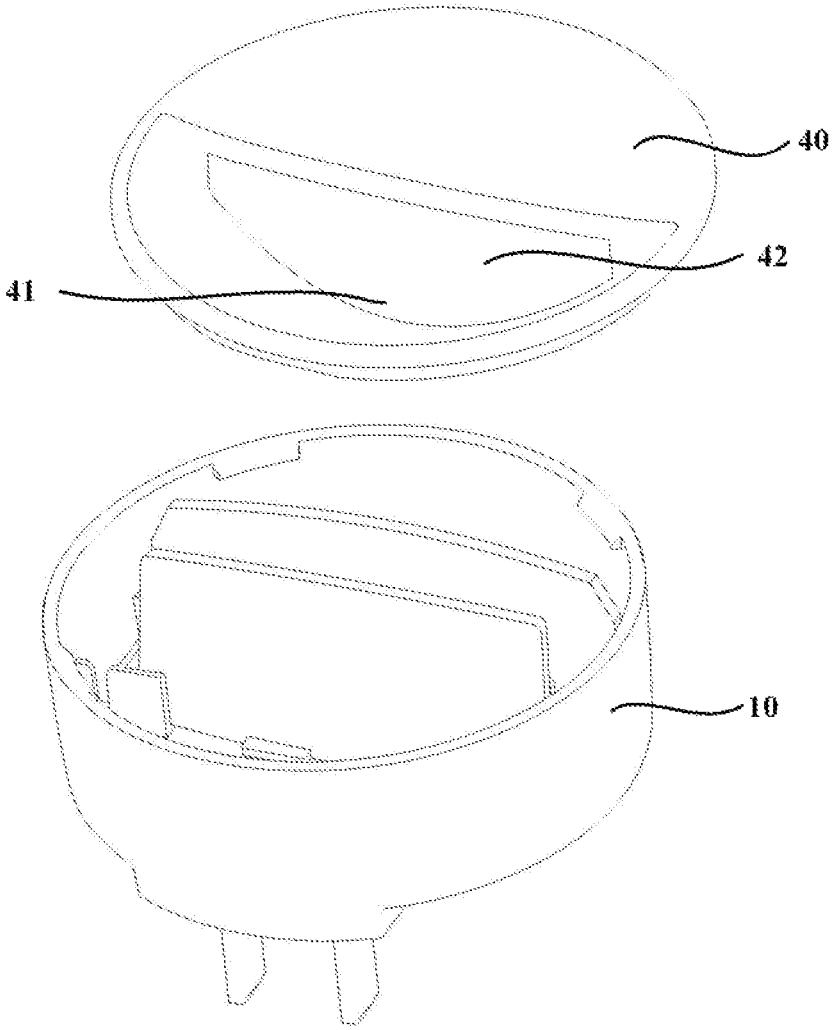
FIG. 7 is a schematic diagram of a mounting a cover according to an example of the present disclosure.

In an example, as illustrated in FIG. 7, in order to obtain a better lighting effect, a recess 41 can be disposed on the cover 40, and a light-emitting plate 42 is disposed on a side of the recess close to the light source module 20, as illustrated in FIG. 7. The cover 40 and the base 10 are connected with each other to form a complete lamp housing.

Figure 8:
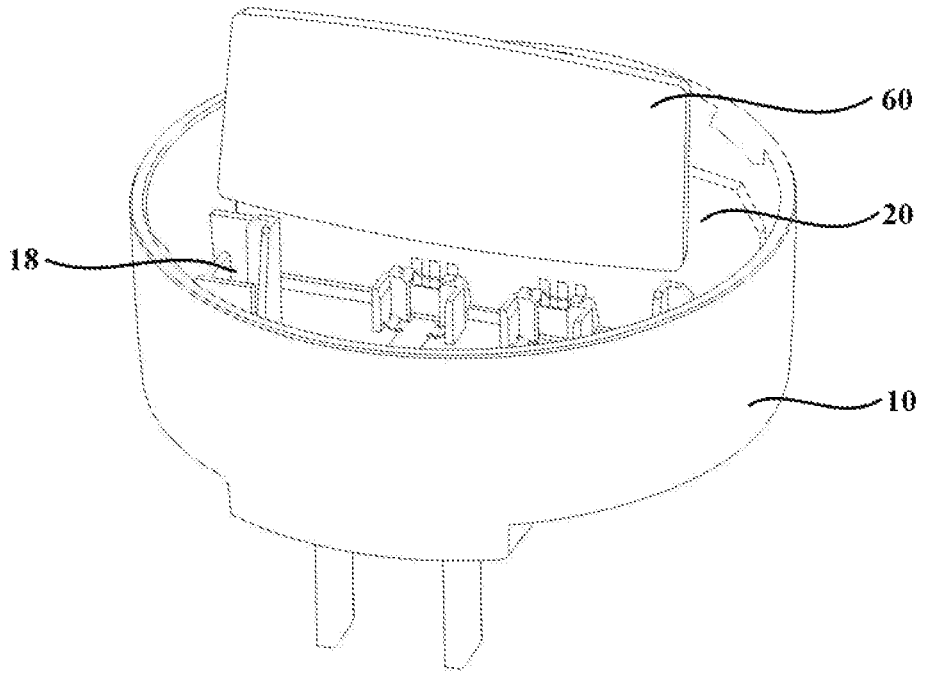
FIG. 8 is a schematic diagram of mounting a diffusion element on a base according to an example of the present disclosure.

According to an example of the present disclosure, the above-mentioned lamp can further include a diffusion element 60 disposed on a side of the light source module 20 where a light source is mounted, and a second receiving slot 18 that is parallel with the first receiving slot 16 and perpendicular to the bottom wall 13 is further provided at a position where each of the two ends of the clamping part is connected with the side wall 13; the second receiving slot 18 is configured to receive and fix the diffusion element 60. The diffusion element 60 is fixed on the base 10 through the second receiving slot 18, as illustrated in FIG. 8. When the plug-type lamp is powered on, the light source on the light source module 20 can be lighted. The light irradiated on the diffusion element 60 is diffused, so that the light as emitted will be softer and more uniform with a larger irradiation area.

Based on the solution provided by the above example, an assembling process of the plug-type lamp as mentioned above can include steps as below:

Step 1, taking out the base 10 of the lamp with the plug pin;

Step 2, taking out the conductive terminals 30; sequentially mounting the two conductive terminals 30 on the base 10; and embedding the sharp portions 33 of the two conductive terminals 30 into the second ribs 17 on the base 10, respectively;

Step 3, taking out the light source module 20 of the lamp, and positioning the light source module 20 in the first receiving slots 16 at both sides of the base 10, with the bare copper facing the conductive terminal 30.

Figure 9:
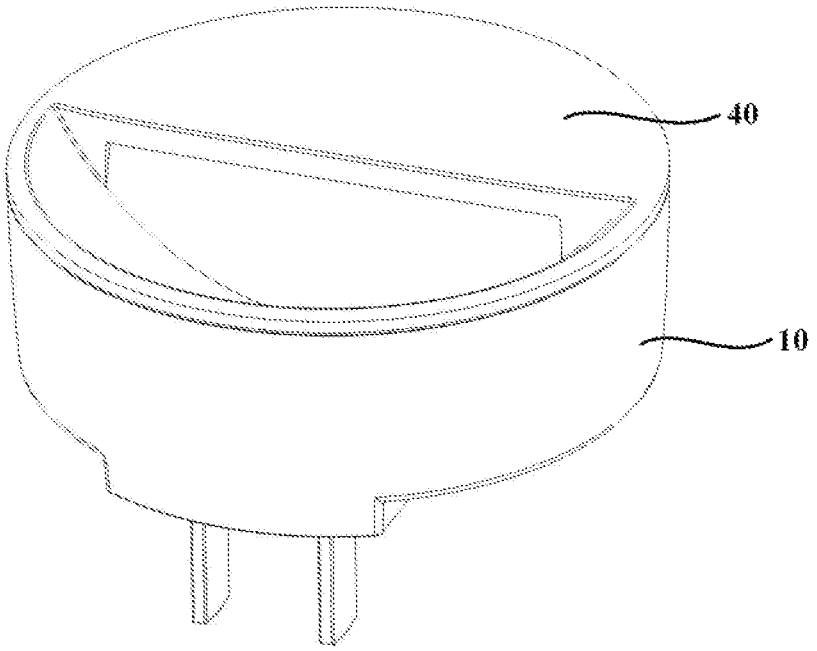
FIG. 9 is a schematic diagram of a plug-type lamp according to an example of the present disclosure.

Step 4, inserting the diffusion element 60 into the second receiving slots 18 at both sides of the base 10;

Step 5, taking out the cover 40, and covering the cover 40 onto the base 10 to complete the assembly of the plug-type night light/lamp. The appearance of the entire lamp is illustrated in FIG. 9.

The example of the present disclosure provides a more practical plug-type lamp in which the stable electrical connection between the plug pin and the light source module as well as the quick installation are completed by designing the conductive terminal with an installation guiding structure, a retracting-preventing structure and a resilience structure. Not only does it eliminate the need for manual welding of cables, but it also solves the issue of thermal deformation of the plastic part of the plug pin due to welding, which in turn improves the efficiency by replacing manual welding and improves the stability of manufacturing process, resulting in an effective increase in production efficiency.

Thus, the plug-type lamp provided by the examples of the disclosure solves the issue that the plastic part of the plug pin would be deformed due to heat generated in welding, thereby improving the current low manual welding efficiency and unstable manufacturing process, so as to effectively improve the production efficiency.

According to an aspect of the present disclosure, a plug-type lamp is provided. The plug-type lamp may include: a base with a plug part, wherein the plug part may be configured to be plugged in a socket and be electrically connected with the socket; a light source module housed in the base; a pair of conductive terminals configured to electrically connect the plug part with the light source module; and a cover assembled with the base.

Optionally, the base has a bottom wall and a side wall extending perpendicularly from an outer periphery of the bottom wall.

Optionally, the plug part comprises two plug pins; a through hole configured to receive and fix each of the plug pins is disposed on a bottom wall of the base, a first rib perpendicular to the bottom wall is disposed on both sides of the through hole, respectively; and the first rib is configured to position an end of each of the conductive terminals which is in contact with the plug pin.

Optionally, the light source module is provided with two power supply contacts; and the other end of each of the conductive terminals is in contact with one of the two power supply contacts.

Optionally, a clamping part configured to receive the light source module is formed on the side wall by two ends of the clamping part extending from opposite locations of the side wall; a first receiving slot perpendicular to the bottom wall is disposed at a position where each of the two ends of the clamping part is connected with the side wall, the first receiving slot is configured to receive and fix the light source module; and the light source module is insertable in the first receiving slot so as to be fixed on the base.

Optionally, a second rib perpendicular to the bottom wall is disposed at a middle of the clamping part, the second rib is configured to fix the other end of each of the conductive terminals.

Optionally, the end of the conductive terminal that is in contact with the plug pin have both sides extending downward to form a double-V-shaped bend, and the double-V-shaped bend is configured to clamp the plug pin to keep the conductive terminal being in close contact with the plug pin.

Optionally, the other end of the conductive terminal that is in contact with one of the power supply contacts has a central portion extending upward to form an inverted-V-shaped bend, and a resilience force is formed upon the inverted-V-shaped bend being in contact with the power supply contact, so as to keep the conductive terminal being in close contact with the power supply contact.

Optionally, the conductive terminal is provided with an upward-protruding sharp portion on both sides of an end of the conductive terminal which is close to the power supply contact, and the sharp portion is embedded in the second rib.

Optionally, the power supply contact is formed as a plurality of vertically arranged, strip-shaped, metal sheets.

Optionally, a recess is disposed on the cover, a side of the recess close to the light source module is provided with a light-emitting plate; and the cover and the base are connected with each other to form a complete lamp housing.

Optionally, the plug-type lamp further includes: a diffusion element disposed on a side of the light source module where a light source is mounted; a second receiving slot that is parallel with the first receiving slot and is perpendicular to the bottom wall is further disposed at a position where each of the two ends of the clamping part is connected with the side wall, the second receiving slot is configured to receive and fix the diffusion element; and the diffusion element is insertable in the second receiving slot so as to be fixed on the base.

The disclosure provides a plug-type lamp, which can achieve a stable electrical connection structure without manual welding of cables, by contacting ends of two conductive terminals with two plug pins, respectively, and by contacting the other ends of the two conductive terminals with two power supply contacts, respectively. At the same time, the issue that the plastic part of the plug pin is heated and deformed due to welding is solved, thereby improving the current low efficiency of manual welding and the unstable manufacturing process, so that the production efficiency is effectively improved.

In the description provided herein, a great deal of specific details is explained. However, it can be understood that examples of the present disclosure can be practiced without these specific details. In some instances, well-known methods, structures, and techniques have not been illustrated in detail in order not to obscure the understanding of this description.

Similarly, it should be understood that, in order to simplify the disclosure and aid in the understanding of one or more aspects of the various examples of the disclosure, in the above description of the examples of the disclosure, various features of the disclosure are sometimes grouped together into a single example, drawing, or its description. However, the method of the disclosure should not be interpreted as reflecting an intention that the claimed disclosure requires more features than those specifically recited in each claim. More specifically, as the following claims reflect, inventive aspects lie in less than all features of a single foregoing disclosed example. Thus, the claims following the detailed description are hereby expressly incorporated into this detailed description, with each claim standing on its own as a separate example of the disclosure.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors.

In addition, those skilled in the art can understand that, although some examples described herein include some features included in other examples rather than other features, combinations of features of different examples are meant to be within the scope of the present disclosure and form different examples.

It should be noted that the above examples illustrate the present disclosure and do not limit the present disclosure. And that those skilled in the art can design alternative examples without departing from the scope of the appended claims. In the claims, any reference signs placed between parentheses shall not be construed as limiting the claim. The words such as "comprising," "comprise," "including," "include" does not exclude the presence of elements or steps not listed in a claim. The word "a" or "an" preceding an element does not exclude the presence of a plurality of such elements. The disclosure can be implemented by means of hardware comprising several different elements and by means of a suitably programmed computer. In the unit claims enumerating several components, several of these components can be embodied by one and the same item of hardware. The use of the words "first", "second", "third", etc. do not denote any order. These words can be interpreted as names.

Heretofore, those skilled in the art will recognize that, although various examples of the present disclosure have been illustrated and described in detail herein, Many other variations or modifications consistent with the principles of the present disclosure can be directly determined or deduced according to the content of the present disclosure without departing from the spirit and scope of the present disclosure. Therefore, the scope of the present disclosure should be understood and determined to cover all such other variations or modifications.

What is claimed is:

1. A plug-type lamp, comprising:

a base with a plug part, the plug part being configured to be plugged in a socket and be electrically connected with the socket;

a light source module housed in the base;

a pair of conductive terminals configured to electrically connect the plug part with the light source module;

a cover assembled with the base, wherein the base has a bottom wall and a side wall extending perpendicularly from an outer periphery of the bottom wall; and a clamping part disposed on the side wall via two ends of the clamping part extending from opposite locations on the side wall, wherein a first receiving slot perpendicular to the bottom wall is disposed at a position where each of the two ends of the clamping part is connected with the side wall, and the first receiving slot is configured to receive and fix the light source module, and wherein the light source module is insertable in the first receiving slot so as to be fixed on the base.

2. The plug-type lamp according to claim 1, wherein:

the plug part comprises two plug pins, and a through hole configured to receive and fix each of the plug pins is disposed on a bottom wall of the base, and a first rib perpendicular to the bottom wall is disposed on both sides of the through hole, and the first rib is configured to regulate a position for an end of each of the conductive terminals which is in contact with the plug pin.

3. The plug-type lamp according to claim 2, wherein:

the light source module is provided with two power supply contacts, and the other end of each of the conductive terminals is in contact with one of the two power supply contacts.

4. The plug-type lamp according to claim 3, wherein: a second rib perpendicular to the bottom wall is disposed at a middle of the clamping part, and the second rib is configured to fix the other end of each of the conductive terminals.

5. The plug-type lamp according to claim 3, wherein the end of the conductive terminal that is in contact with the plug pin have both sides extending downward to form a double-V-shaped bend, and the double-V-shaped bend is configured to clamp the plug pin to keep the conductive terminal being in close contact with the plug pin.

6. The plug-type lamp according to claim 5, wherein the other end of the conductive terminal that is in contact with one of the power supply contacts has a central portion extending upward to form an inverted-V-shaped bend, and a resilience force is formed upon the inverted-V-shaped bend being in contact with the power supply contact so as to keep the conductive terminal being in close contact with the power supply contact.

7. The plug-type lamp according to claim 4, wherein the conductive terminal is provided with an upward-protruding sharp portion on both sides of an end of the conductive terminal which is close to the power supply contact, and the sharp portion is embedded in the second rib.

8. The plug-type lamp according to claim 3, wherein the power supply contact is formed as a plurality of vertically arranged, strip-shaped, metal sheets.

9. The plug-type lamp according to claim 1, wherein a recess is disposed in the cover, a side of the recess close to the light source module is provided with a light-emitting plate, and the cover and the base are connected with each other to form a complete lamp housing.

10. The plug-type lamp according to claim 1, further comprising:

a diffusion element disposed on a side of the light source module where a light source is mounted, a second receiving slot that is parallel with the first receiving slot and is perpendicular to the bottom wall is further disposed at a position where each of the two ends of the clamping part is connected with the side wall, and the second receiving slot is configured to receive and fix the diffusion element, and the diffusion element is insertable in the second receiving slot so as to be fixed on the base.

11. A method of producing a plug-type lamp, comprising:

providing a base with a plug part wherein the plug part is configured to be plugged in a socket and be electrically connected with the socket;

providing a light source module housed in the base;

providing a pair of conductive terminals configured to electrically connect the plug part with the light source module;

providing a cover assembled with the base, wherein the base has a bottom wall and a side wall extending perpendicularly from an outer periphery of the bottom wall; and providing a clamping part on the side wall by two ends of the clamping part extending from opposite locations on the side wall, and disposing a first receiving slot perpendicular to the bottom wall at a position where each of the two ends of the clamping part is connected with the side wall, wherein the first receiving slot is configured to receive and fix the light source module, and the light source module is insertable in the first receiving slot so as to be fixed on the base.

12. The method according to claim 11, wherein the plug part comprises two plug pins, and the method further comprises:

providing a through hole that is configured to receive and fix each of the plug pins wherein the through hold is disposed on a bottom wall of the base, and disposing a first rib that is perpendicular to the bottom wall on both sides of the through hole, wherein the first rib is configured to regulate a position for an end of each of the conductive terminals which is in contact with the plug pin.

13. The method according to claim 12, further comprising:

providing the light source module with two power supply contacts, and contacting the other end of each of the conductive terminals with one of the two power supply contacts.

14. The method according to claim 13, further comprising:

disposing a second rib perpendicular to the bottom wall at a middle of the clamping part, wherein the second rib is configured to fix the other end of each of the conductive terminals.

15. The method according to claim 13, wherein the end of the conductive terminal that is in contact with the plug pin have both sides extending downward to form a double-V-shaped bend, and the double-V-shaped bend is configured to clamp the plug pin to keep the conductive terminal being in close contact with the plug pin.

16. The method according to claim 15, wherein the other end of the conductive terminal that is in contact with one of the power supply contacts has a central portion extending upward to form an inverted-V-shaped bend, and a resilience force is formed upon the inverted-V-shaped bend being in contact with the power supply contact so as to keep the conductive terminal being in close contact with the power supply contact.

17. A plug-type lamp, comprising:

a base with a plug part, the plug part being configured to be plugged in a socket and be electrically connected with the socket;

a light source module housed in the base;

a pair of conductive terminals configured to electrically connect the plug part with the light source module;

a cover assembled with the base, wherein the base has a bottom wall and a side wall extending perpendicularly from an outer periphery of the bottom wall;

a clamping part configured to receive the light source module, wherein two ends of the clamping part are connected with the side wall; and a first receiving slot is disposed at a position where each of the two ends of the clamping part is connected with the side wall, wherein the first receiving slot is configured to receive and fix the light source module.

* * * * *